US005372104A

United States Patent [19]

Griffin

[11] Patent Number: 5,372,104

[45] Date of Patent: Dec. 13, 1994

[54] ROTARY VALVE ARRANGEMENT

[76] Inventor: Bill E. Griffin, P.O. Box 64, Gunter, Tex. 75058

[21] Appl. No.: 133,975

[22] Filed: Oct. 8, 1993

[51] Int. Cl.[5] ..... F01L 7/02

[52] U.S. Cl. ..... 123/190.2

[58] Field of Search ..... 123/190.1, 190.2, 190.17

[56] References Cited

U.S. PATENT DOCUMENTS

| | | | |
|---|---|---|---|
| 1,971,060 | 8/1934 | Wills | 123/190.17 |
| 3,892,220 | 7/1975 | Franz | 123/190.17 |
| 4,019,487 | 4/1977 | Guenther | 123/190.2 |
| 4,114,639 | 9/1978 | Cross et al. | 123/190.17 |
| 4,198,946 | 4/1980 | Rassey | 123/190.2 |
| 4,467,751 | 8/1984 | Asaka et al. | 123/190.17 |
| 5,152,259 | 10/1992 | Bell | 123/190.2 |
| 5,205,251 | 4/1993 | Conklin | 123/190.2 |

FOREIGN PATENT DOCUMENTS

| | | | |
|---|---|---|---|
| 0059047 | 9/1982 | European Pat. Off. | 123/190.2 |
| 0099873 | 2/1984 | European Pat. Off. | 123/190.2 |

*Primary Examiner*—E. Rollins Cross
*Assistant Examiner*—Erick Solis
*Attorney, Agent, or Firm*—Charles C. Garner

[57] ABSTRACT

A rotary valve arrangement for engines and the like has sealing members and rings inset into the valve rotor which rotates within a loosely fitted rotor sleeve so that only the sealing elements are in contact. The rotor sleeve is mounted between a cylinder head, affixed by a conventional bolt pattern, and a rotor cover so that the rotor sleeve is placed between the cylinder bolts and the valve rotor.

6 Claims, 5 Drawing Sheets

ROTARY VALVE ARRANGEMENT

FIELD OF THE INVENTION

This invention relates to the construction of internal combustion engines, compressors and more particularly to the use of rotary valves for controlling the flow of gases into and out of the working volume.

BACKGROUND AND SUMMARY OF THE INVENTION

Rotary valves have long been known and used in various forms for internal combustion engines and compressors. The usage of such valves soon fell into disfavor however, in spite of some desirable features inherent to their design. Sealing of rotary valves has heretofore required a precise, close tolerance fit-up, somewhat at odds with the realities of the application. Over and above the costs exacted by the required manufacturing precision, a greater problem has been high maintenance requirements. Differential heating and expansion of parts, further aggravated by the build-up of deposits, has caused valve sticking and poor reliability. As a result, the less demanding poppet valve has come to enjoy virtually universal acceptance.

In recent years, fuel economy and pollution control requirements have changed the standards of the marketplace, giving the desirable features of rotary valves a new significance. Rotary valves have a potential for unobstructed flow, providing cylinder filling and exhaust efficiencies exceeding those of the most sophisticated multi-valve poppet arrangements.

Moreover, the symmetrical, straight through rotary valve design as taught by Smith U.S. Pat. No. 3,896,781 or Negre et al. U.S. Pat. No. 4,506,636 as well as others, need only rotate at one-quarter engine speed in a four-cycle engine application. Between openings, the cylindrical surface of the valve rotor becomes a portion of the combustion chamber. Since alternating, relatively cool surface areas and passageway ends are engaged on each intake or exhaust stroke, the fuel/air mixture flow is not threatened by premature, "hot spot" ignition and higher compression ratios are tolerable. Moreover, since poppet exhaust valve cooling is normally aided by impingement of the incoming charge during an overlap of inlet and exhaust open periods, some of the charge flows through and around the exhaust valve. This adversely affects both emission controls and fuel economy. Rotary valves have heretofore not realized true commercial success, mainly because of cost, reliability and maintenance considerations, but the attractive potential of rotary valve engines is clear. Inasmuch as the market has now accepted the expensive overhead cam, four valve-per-cylinder engine designs at the high end, relative cost is no longer a decisive factor.

An object of the present invention is therefore, to provide a rotary valve assembly which can operate reliably with generous clearances so that differential thermal expansion and combustion deposits will not be a source of maintenance problems.

A second object of the present invention is to provide this reliable rotary valve system without any compromise of flow area.

Yet another object of the present invention is to provide a rotary valve system which can be readily adapted to pre-existing conventional engines as an economical, easily assembled after-market replacement cylinder head assembly or an original equipment option.

The potential flow area of rotary valves is related to the diameter of the valve body and the angular duration of the valve open period. Although no precise relationship is mandated, valve body diameter should be two-thirds of the engine piston diameter or greater in order to allow effective flow area. The valve rotor of the present invention is fitted into its housing for free rotation with sufficient clearance to avoid binding due to heat distortion or combustion deposits. The valve rotor rotates once for every four crankshaft revolutions in a four-cycle engine so that the combustion chamber is alternately opened to opposite ends of a diametral port and closed by the opposed cylindrical surfaces. Sealing elements make the only contact between the valve rotor and the housing and, in order to seal the combustion chamber volume during the compression and power strokes, these elements surround the closing area thus, two sets of elements are involved. The two sets of seals alternate in sealing the combustion chamber volume, which reduces the severity of their service requirement and, rotating at one-quarter engine speed, the contact velocity of the sealing elements is relatively low.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
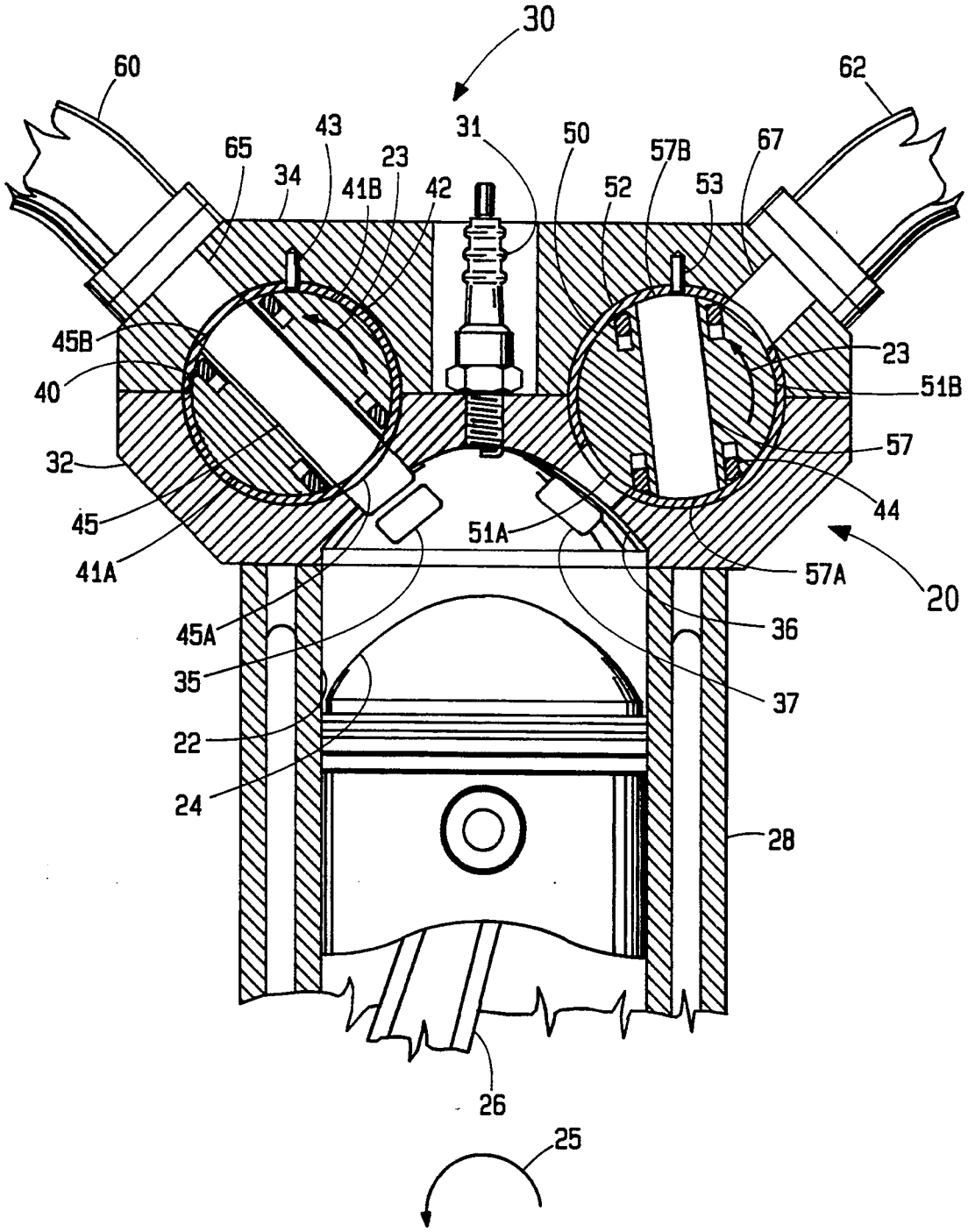
FIG. 1 is a cross section view of a preferred embodiment of the present invention as installed for operation on an otherwise conventional four-cycle spark ignition engine, the view being taken at the centerline of a typical cylinder thereof.

Referring to FIG. 1, there is shown a cross section of a single cylinder assembly 20 for a typical four-cycle spark ignition engine utilizing the rotary valve system of the present invention. Cylinder assembly 20 comprises cylinder 22, piston 24, connecting rod 26, engine block 28 and cylinder head assembly 30. Connecting rod 26 is attached at its unshown lower end to a crankshaft which, as it rotates, varies the volume of the chamber defined by piston 24, cylinder 22 and combustion chamber 36. The engine configuration is not restricted as to number and arrangement of cylinders. Cylinder head assembly 30 includes spark plug 31, cylinder head 32 and rotor cover 34. Combustion chamber 36 is formed in cylinder head 32 and includes chamber inlet 35 and chamber outlet 37. Intake valve rotor 40 and exhaust valve rotor 50 are fitted to rotate freely within intake sleeve 42 and exhaust sleeve 52 respectively, which are prevented from rotating in turn by dowel pins 43 and 53. Intake manifold 60 and exhaust manifold 62 are affixed to rotor cover 34 and aligned with intake port 65 and exhaust port 67 respectively.

Valve rotors 40 and 50 are driven to rotate, as indicated by arrows 23, in an engine-wise direction at one-quarter of the speed of the engine rotation indicated by arrow 25. Intake rotor port 45 is aligned with chamber inlet 35 and intake port 65 at the illustrated angle of rotation, which corresponds to engine crankshaft rotation of 90 degrees "after top center". At this point, exhaust valve rotor 50 has rotated so that end 57A of exhaust rotor port 57 has passed alignment with chamber outlet 37, and exhaust rotor cylindrical surface 51A then blocks chamber outlet 37 for the duration of the compression and combustion sequence. During this time, chamber inlet 35 and outlet 37 are sealed by sealing members 44, which cooperate with sealing rings 46 as is shown subsequently. As the power cycle is completed, end 57B of exhaust rotor port 57 rotates into alignment with chamber outlet 37 to begin the exhaust cycle. In the same manner, exhaust rotor cylindrical surfaces 51A and 51B alternate in blocking chamber outlet 37. Intake valve rotor 40 operates symmetrically, with the ends 45A and 45B of intake rotor port 45, and the intake rotor cylindrical surfaces 41A and 41B also alternating in their respective sealing functions.

Figure 2:
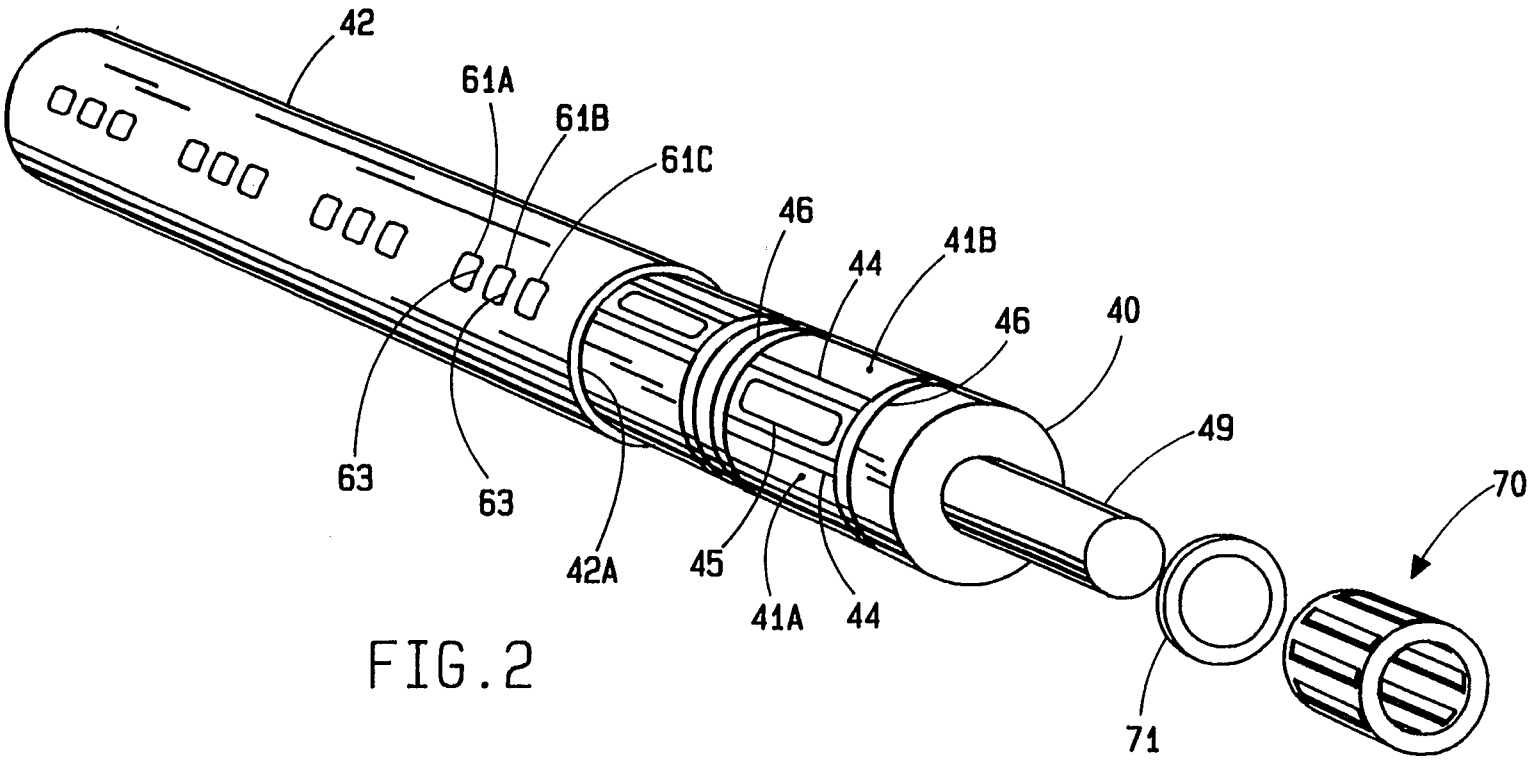
FIG. 2 shows the valve rotor, bearing and sleeve assembly of the embodiment of FIG. 1.

In FIG. 2 is shown a view of an intake valve rotor 40 and intake sleeve 42 which would be similar to a corresponding exhaust valve rotor 50 in a given engine assembly. The intake valve rotor 40 is fitted to the intake sleeve 42 with a diametral clearance in the order of 0.010" and a bearing 70 is fitted on a shaft extension 49 at each end thereof. In this manner, the intake valve rotor 40 has a running clearance of 0.005". The diameter of intake valve rotor 40 provides a structural stiffness such that operating loads imposed by compression and combustion pressures do not cause any significant deflection and therefore, inner surface 42A of intake sleeve 42 is contacted only by sealing members 44, inset into valve rotor 40 and inset sealing rings 46, which encircle valve rotor 40. Thrust washers 71 support axial loads and allow rotor end play adjustment.

Other factors being equal, the cross-sectional area of the rotor ports determines the volume of the gases flowing into and out of the engine and hence, the power output. The portion of the circumference of intake rotor 40 or exhaust rotor 50 which can be dedicated to ports 45 or 57 respectively is fixed by the fairly rigid demands of cycle timing. In order to enlarge port area, the axial dimension is increased. Sleeve intake port 61 is divided into segments 61A, 61B and 61C so that the integrity of sealing members 44 is protected by the inclusion of seal retaining bars 63 therebetween.

Figure 3:
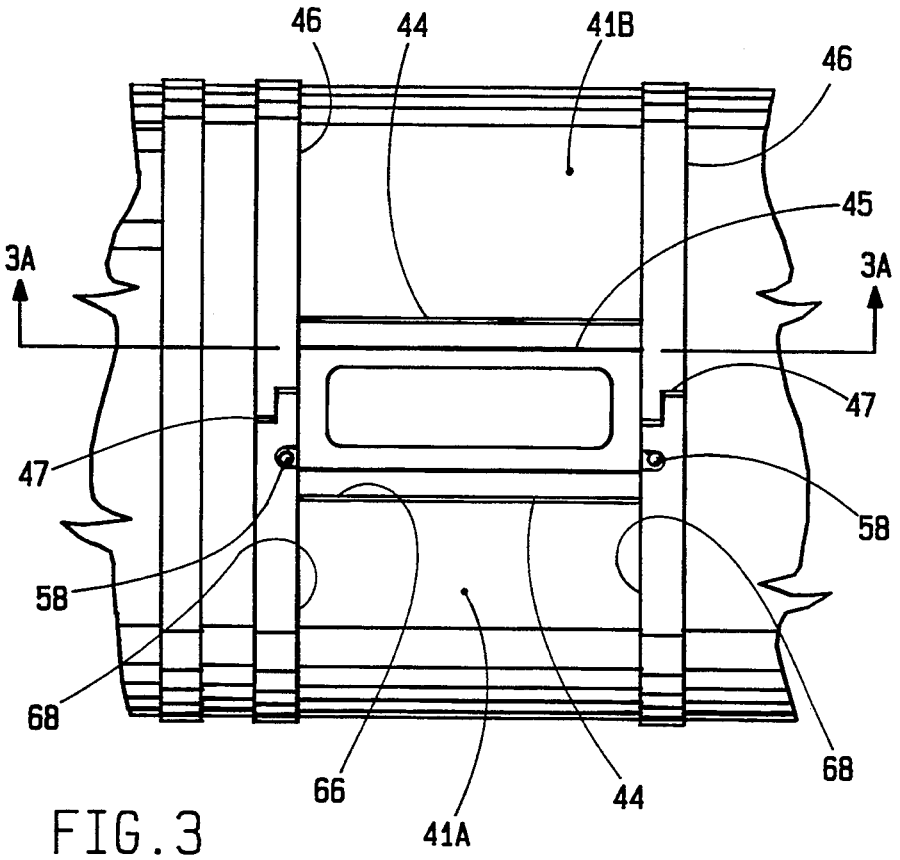
FIG. 3 is an enlarged detail view of the combustion chamber seal arrangement of the preferred embodiment of the invention.
Figure 3A:
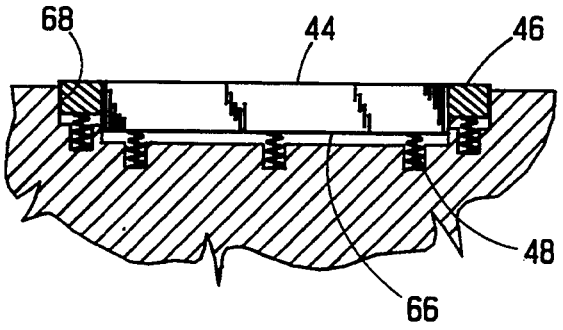
FIG. 3A shows a view taken along section line 3A—3A of FIG. 3.
Figure 3B:
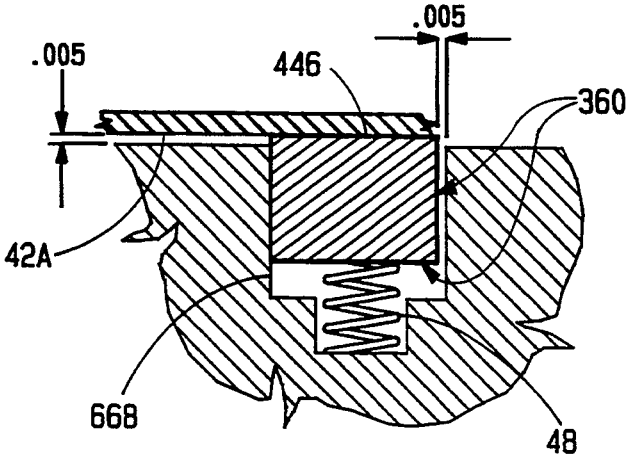
FIG. 3B shows a typical section view of the seals shown in FIG. 3.

FIGS. 3, 3A and 3B show the installation of sealing members 44 and sealing rings 46 in greater detail. The sealing member grooves 66 and the sealing ring grooves 68 are machined to allow 0.005" fitting clearance on sealing members 44 and sealing rings 46. These parts may be made of metallic, phenolic or polyurethane materials and, depending upon elasticity, cut joints 47 may be needed to permit installation of sealing rings 66. Seal pins 58 may be used to keep sealing rings 66 from rotating on rotor 40 which prevents wear of seal grooves 68 and also holds joint 47 in the vicinity of port 45 to prevent leakage at combustion sealing cylindrical surfaces 41A and 41B. Seal springs 48 maintain light sealing contact with sleeve inner surface 42A and pressure in combustion chamber 36 reinforces this contact to make a positive seal. This action is shown in FIG. 3B where seal body 446 is seen to be pushed outwardly against groove 668 and sleeve inner surface 42A by movement of gases 360 under pressure.

Figure 4:
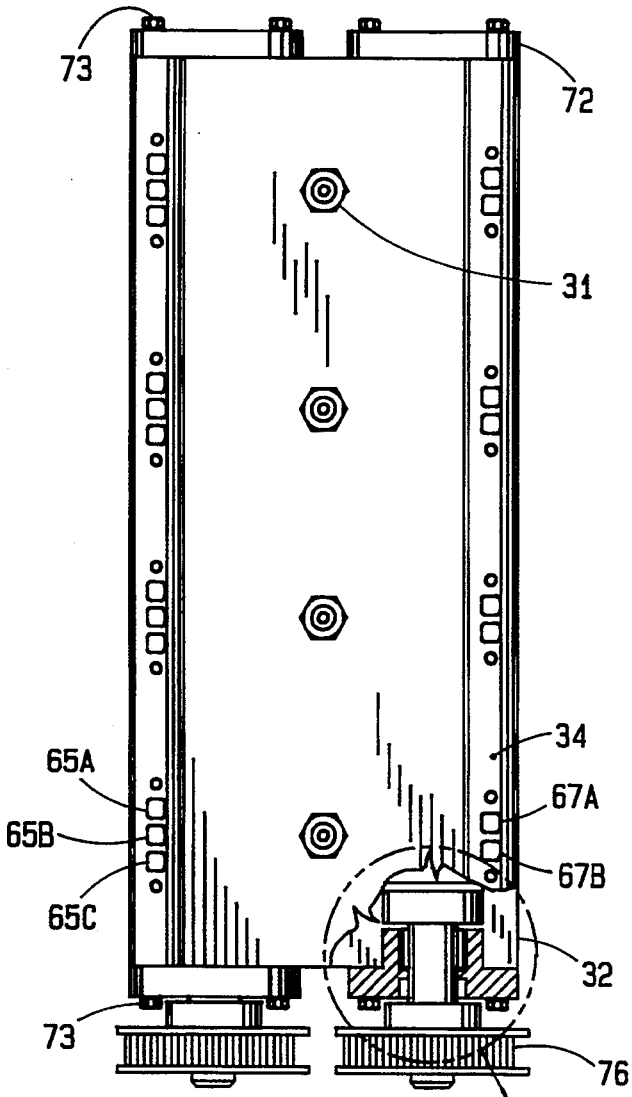
FIG. 4 shows a plan view of the embodiment of FIG. 1.
Figure 4A:
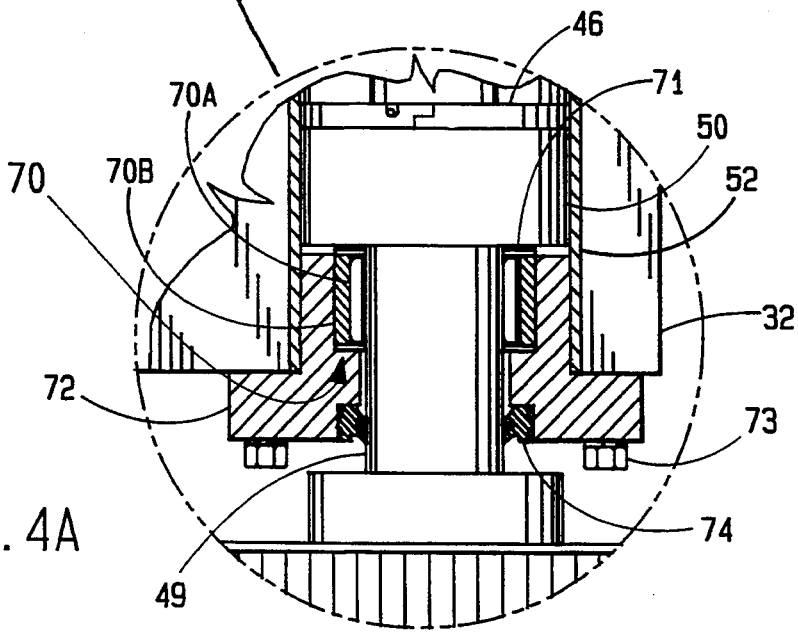
FIG. 4A is an enlarged view of the indicated portion of FIG. 4 showing the valve rotor bearing installation.

FIG. 4 shows the installation of bearings 70 for exhaust rotor 50 which is the same for a corresponding intake valve rotor 40 in a given engine assembly. Bearing 70 comprises needle/cage assembly 70A and outer race 70B. The outer race 70B is pressed into bearing cap 72 while needle cage assemble rotates on shaft extension 49. Thrust washers 71 are selectively fitted to control end play for exhaust rotor 50. Exhaust sleeve 52 is fitted closely and held between cylinder head 32 and rotor cover 34. Shaft extension 49 passes through seal 74 for mounting of toothed drive sprocket 76. In this manner, the running clearance of approximately 0.005" is maintained while exhaust rotor 50 is driven to rotate within exhaust sleeve 52. It is noteworthy that fitting bearing caps 72 closely inside of intake and exhaust sleeves 42 and 52 acts to maintain the desired concentricity.

Figure 5:
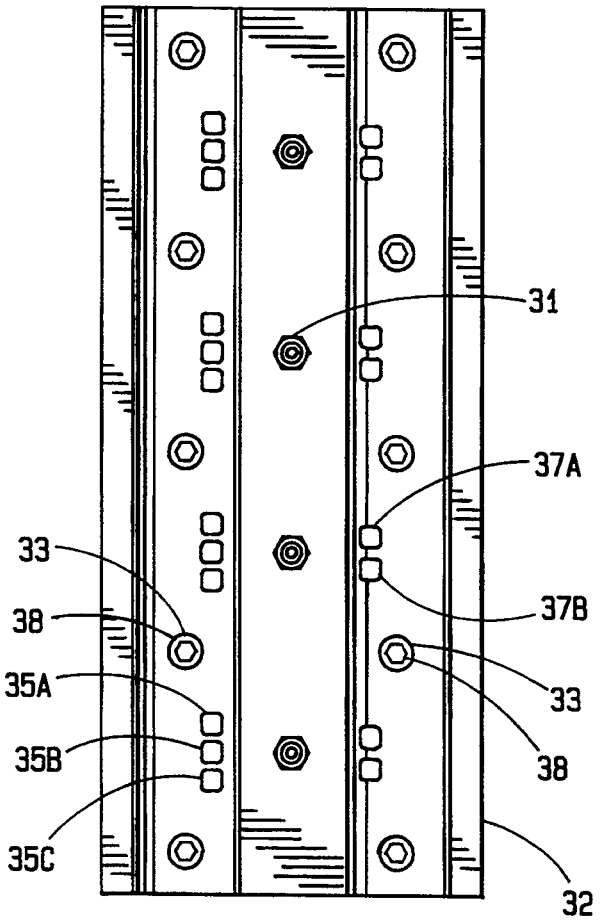
FIG. 5 is a plan view of the cylinder head of FIG. 1, with the valve rotors and cover removed showing the cylinder head bolting arrangement.

FIG. 5 shows the cylinder head 32 with rotor cover 34, valve rotors 40 and 50 and sleeves 42 and 52 removed, thereby revealing counter-bred cylinder bolt holes 33, with cylinder head bolts 38 installed to hold the cylinder head assembly 30 in place on engine block 28. It can be seen that intake and exhaust sleeves 42 and 52 cover cylinder head bolt holes 33. In this manner intake and exhaust valve rotors 40 and 50 does not interfere with the cylinder head bolt pattern, and the present invention can be adapted for installation on virtually any engine. This flexibility is particularly significant for the twin overhead rotor configuration of this embodiment. Upon disassembly, only the lower bearing cap bolts which engage cylinder head 32 are removed. Thus, when rotor cover 34 is lifted from the cylinder head assembly 30, sleeves 42 and 52, and rotors 40 and 50 come along as a subassembly.

Figure 6:
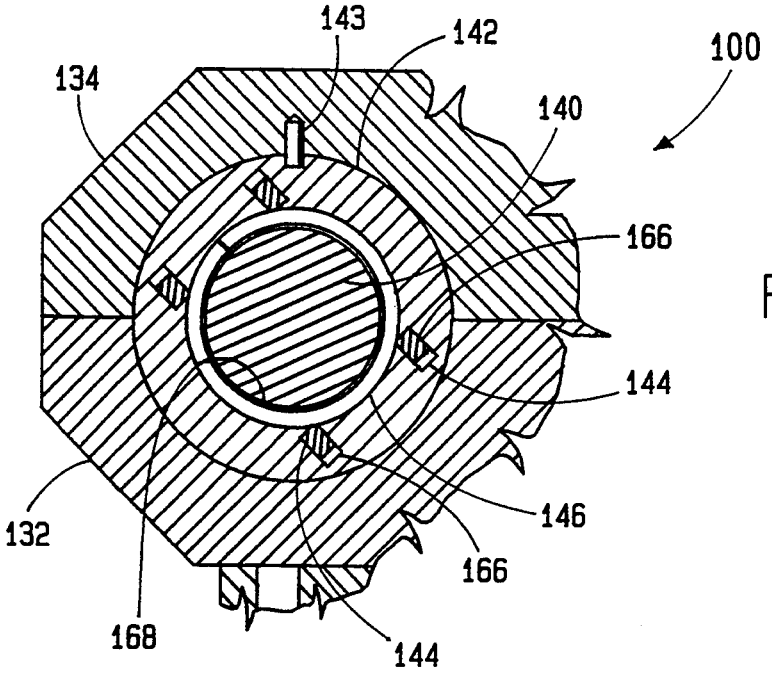
FIG. 6 is a partial cross section showing an alternative sealing arrangement.

FIG. 6 is a cross sectional view of a second valve rotor embodiment 100 taken at the plane of sealing ring groove 168 and shows sleeve 142 to have a relatively thicker wall to accept sealing member grooves 166 placed adjacent the sleeve ports (unshown). Sealing members 144 are installed in grooves 166 for contact with the cylindrical surface of valve rotor 140 so as to provide the required sealing. Sealing rings 146 are inset in valve rotor 140 in sealing ring grooves 168 in the manner, of FIG. 3 and sealing members 144 are lengthened to contact the full width of sealing rings 146. In all other respects, this embodiment 100 is unchanged, with cylinder head 132 and rotor cover 134 holding sleeve 142 in place and dowel 143 preventing relative rotation thereof.

It is to be understood that the present invention is not limited to the disclosed embodiment, but can also be adapted to two-cycle and compression ignition engines, steam engines or compressors, and is fully capable of rearrangement, modification and substitution of parts within the spirit of the invention.

I claim:

1. An engine comprising:

a cylinder;

a rotatable crankshaft;

a piston working within said cylinder under the influence of said crankshaft;

a cylinder head on said cylinder forming an enclosed, variable volume chamber in cooperation with said piston, said cylinder head having an opening therein communicating with said variable volume chamber;

bolting means for affixing said cylinder head to said cylinder;

a cylindrical valve rotor having first and second ends and a port extending diametrically through a portion thereof so that the opposed openings thereof are circumferentially separated by opposed cylindrical surfaces;

a cylindrical rotor sleeve fitting freely around said valve rotor and including therein diametrically opposed sleeve ports matching said opposed openings; and means for mounting said rotor sleeve on said cylinder head on an axis parallel to the axis of rotation of said crankshaft so that one said sleeve port communicates with said variable volume chamber and so that said rotor sleeve at least partially covers said bolting means.

2. An engine according to claim 1 wherein said rotor sleeve ports further comprise:

axially adjacent openings in said rotor sleeve so that the aggregate opening area has an axial dimension substantially greater than the circumferential dimension thereof; and seal retaining bars separating said axially adjacent openings.

3. An engine according to claim 1 and further comprising a valve rotor cover having an opening therein for communicating with said variable volume chamber when said valve rotor is so aligned.

4. An engine according to claim 1 and further comprising bearing means for rotating said valve rotor within said valve rollor sleeve, without contact therebetween, while said variable volume chamber alternately communicates with said opposed rotor openings and is closed by said opposed rotor cylindrical surfaces.

5. An engine according to claim 1 and further comprising means for sealing said closed variable volume engine cheer by contacting said closing opposed cylindrical surfaces and said rotor sleeve.

6. An engine according to claim 5 wherein said sealing means comprises:

sealing rings encircling said valve rotor and axially adjacent said opposed port openings;

means for preventing said sealing rings from rotating relative to said valve rotor; and sealing members inset into said valve rotor parallel to the axis thereof and circumferentially adjacent said opposed rotor port openings.

* * * * *